US008573948B2

(12) United States Patent
Jevons

(10) Patent No.: US 8,573,948 B2
(45) Date of Patent: Nov. 5, 2013

(54) AIRFOIL

(75) Inventor: Matthew P. Jevons, Derby (GB)

(73) Assignee: Rolls-Royce, plc, London (GB)

( * ) Notice: Subject to any disclaimer, the term of this patent is extended or adjusted under 35 U.S.C. 154(b) by 906 days.

(21) Appl. No.: 12/588,755

(22) Filed: Oct. 27, 2009

(65) Prior Publication Data

US 2010/0150707 A1 Jun. 17, 2010

(30) Foreign Application Priority Data

Dec. 17, 2008 (GB) ..... 0822909.8

(51) Int. Cl.
*F01D 5/18* (2006.01)

(52) U.S. Cl.
USPC ..... 416/233; 416/241 A

(58) Field of Classification Search
USPC ..... 416/232, 233, 241 R, 241 A, 241 B; 29/889.7, 889.71, 889.72
See application file for complete search history.

(56) References Cited

U.S. PATENT DOCUMENTS

| | | | | |
|---|---|---|---|---|
| 2,981,337 | A * | 4/1961 | Stuart, III | 416/226 |
| 3,095,180 | A | 6/1963 | Clarke et al. | |
| 4,594,761 | A | 6/1986 | Murphy et al. | |
| 6,454,526 | B1 * | 9/2002 | Cunha et al. | 415/115 |
| 2002/0012587 | A1 | 1/2002 | Farrar et al. | |
| 2009/0232647 | A1 * | 9/2009 | Henkle et al. | 415/200 |

FOREIGN PATENT DOCUMENTS

| | | | |
|---|---|---|---|
| EP | 0 495 276 | A1 | 7/1992 |
| EP | 0 556 047 | A1 | 8/1993 |
| EP | 0 750 957 | A1 | 1/1997 |
| GB | 2 147 055 | A | 5/1985 |
| GB | 2 154 286 | A | 9/1985 |
| GB | 2 235 733 | A | 3/1991 |
| GB | 2 402 716 | A | 12/2004 |
| WO | WO 03/093101 | A1 | 11/2003 |

OTHER PUBLICATIONS

British Search Report issued in British Patent Application No. GB0822909.8, conducted on Apr. 17, 2009.

* cited by examiner

*Primary Examiner* — Edward Look
*Assistant Examiner* — Maxime Adjagbe
(74) *Attorney, Agent, or Firm* — Oliff & Berridge, PLC

(57) ABSTRACT

An airfoil has a hollow shell providing external airfoil surfaces, and a corrugated core within the shell. The core contacts inner surfaces of the shell to support the shell. The airfoil is formed by consolidating a hollow shell pre-form and a corrugated core pre-form. At least a part of the hollow shell has a leading edge shell portion and/or a trailing edge shell portion which, before consolidation of the pre-forms, is a unitary body having a shape which wraps around the respective edge.

20 Claims, 3 Drawing Sheets

AIRFOIL

The present invention relates to airfoils, and particularly hollow airfoils.

BACKGROUND

Hollow airfoils (e.g. fans, blades or vanes) for use in gas turbine engines are known.

For example, hollow metallic fan blades have been in operation for many years and also hollow metallic guide vanes. GB2147055A discloses such a hollow metallic airfoil.

GB2154286A discloses a hollow composite airfoil in which a process for forming the airfoil using carbon, graphite or glass reinforced epoxy resin composites is proposed. The airfoil has an outer shell producing the airfoil surfaces and a corrugated internal support. The shell is formed from stacked assemblies of laminae, one stack for each side of the airfoil and are joined to each other at the leading and trailing edge of the airfoil. A boot at one end of the airfoil and a mounting platform at the other end of the airfoil seal off the interior of the airfoil from the exterior.

SUMMARY

A first aspect of the present invention provides an airfoil having:

a hollow shell providing external airfoil surfaces, and a corrugated core within the shell, the core contacting inner surfaces of the shell to support the shell;

wherein the airfoil is formed by consolidating a hollow shell pre-form and a corrugated core pre-form, and at least a part of the hollow shell has a leading edge shell portion and/or a trailing edge shell portion which, before consolidation of the pre-forms, is a unitary body having a shape which wraps around the respective edge. Preferably, the hollow shell has both the leading edge shell portion and the trailing edge shell portion.

In the hollow composite airfoil of GB2154286A possible lines of weakness are produced at the leading and trailing edges, as these are positions at which stacked assemblies of laminae are joined. Advantageously, by having, according to this aspect of the invention, an edge shell portion at the leading or trailing edge of the hollow shell such a line of weakness can be avoided as the edge shell portion wraps around the respective edge.

When the hollow shell has a leading edge shell portion and a trailing edge shell portion, the edge shell portions may be joined together along a suction side of the airfoil and along a pressure side of the airfoil during consolidation of the pre-forms. Thus the edge shell portions can completely envelope the airfoil, and the number of joins between different portions of the hollow shell can be reduced.

Preferably, each edge shell portion is formed of fibre-reinforced thermoplastic composite material, such as chopped strand reinforced injection moulded thermoplastic. For example, the thermoplastic material can comprise or consist of polyether-ether ketone (PEEK), polyetherketoneketone (PEKK), acrylonitrile butadiene styrene (ABS), or polypropylene (PP). The fibres can be, for example, carbon or glass fibres.

Each edge shell portion may form part of an outer layer of the hollow shell. Thus the hollow shell can have an inner layer and an outer layer. By separating the hollow shell into inner and outer layers, different materials may be used in different parts of the airfoil to improve performance.

Thus, the inner layer can be optimised for load bearing capabilities. The outer layer can be optimised to protect the airfoil against external threats, such as foreign object or erosion damage.

The outer surface of the hollow shell can also be adapted or treated to provide low adhesion to dirt and ice, chemical protection, and/or protection against lightning strike damage. For example, the outer surface can be metallised.

The inner layer of the hollow shell may be formed from laminated fibre-reinforced pre-impregnated portions. The fibres may be carbon or glass fibres. The impregnation material may be a plastic material. Preferably it is a thermoplastic material such as PEEK.

Preferably, the inner layer is formed from a suction side shell portion and a pressure side shell portion, these two portions being joined during consolidation at the leading and trailing edges. In this way, the join at the leading edge can be protected by a leading edge shell portion of the outer layer, and the join at the trailing edge can be protected by a trailing edge shell portion of the outer layer. For example, the suction and pressure side shell portions can be two stacked assemblies of pre-impregnated fibre-reinforced laminae, the assemblies being joined during consolidation at the leading and trailing edges. Such assemblies may be consolidated into respective unitary bodies before consolidation of the airfoil, or alternatively may only be consolidated themselves during consolidation of the airfoil.

Preferably, surfaces of the core and inner surfaces of the hollow shell are formed of thermoplastic material, the core surfaces and the hollow shell inner surfaces being joined together during consolidation of the pre-forms.

For example, the core may be formed of fibre-reinforced thermoplastic composite material. Preferably, the core is a laminated fibre-reinforced part pre-impregnated with thermoplastic. Alternatively, the core may be formed of thermoplastic coated metallic material.

Preferably, the airfoil is an airfoil component of a gas turbine engine, such as a guide vane.

Surfaces of the core and inner surfaces of the hollow shell may define passages which extend along the airfoil. Preferably, one or more of the passages are configured to act as fluid or wiring conduits. Typically, the surfaces of the core and the inner surfaces of the hollow shell are formed of thermoplastic material.

Conventional metallic hollow airfoils can be unsuitable for acting as system conduits. In particular typical fluids which may need to be conveyed in engine contexts, such as hydraulic fluids, fuel, etc., can chemically attack metallic cores and skins. Although epoxy resin composite hollow airfoils can be chemically resistant, their operational temperature range would likely prohibit the conveying of hot fluids through them. Indeed, GB2154286A proposes sealing off the interior of the hollow composite airfoil disclosed therein. In contrast, by forming the surfaces of the core and the inner surfaces of the hollow shell of thermoplastic material, fluid conduits can be formed which are both chemically resistant and have improved temperature capabilities relative to epoxy resin. For example, the thermoplastic material can be PEEK.

The airfoil may further have end caps at the ends of the airfoil, the end caps having openings which provide access to the passages. In this way, fluid and/or wiring can enter and exit through the passages. Indeed, the airfoil may further have fluid flow pipes and/or wiring passing through one or more of the passages.

Preferably, the airfoil is an airfoil component of a gas turbine engine, such as a guide vane.

A second aspect of the invention provides the use of the airfoil of the previous aspect for the transport of fluid and/or wiring, wherein the fluid and/or wiring is conveyed through one or more passages of the airfoil.

A third aspect of the invention provides a method of producing the airfoil of the first aspect, including the steps of:

providing a hollow shell pre-form and a corrugated core pre-form, the hollow shell pre-form having a unitary leading edge shell portion and/or a unitary trailing edge shell portion, wherein each edge shell portion has a shape which wraps around the respective edge;

positioning the corrugated core pre-form within the hollow shell pre-form; and consolidating the hollow shell pre-form and the corrugated core pre-form to produce the airfoil. The consolidation step typically includes pressing and heating the hollow shell pre-form and the corrugated core pre-form to join the pre-forms together.

The positioning step typically includes positioning removable mandrels around the corrugated core pre-form to support the corrugated core pre-form during the consolidation step.

Optional features of the first aspect provide corresponding optional features of the method of the third aspect. For example, the hollow shell pre-form may have an outer layer and an inner layer, the outer layer having each edge shell portion. Preferably, the inner layer is formed from a suction side shell portion and a pressure side shell portion which are joined during consolidation at the leading and trailing edges of the airfoil. The suction and pressure side shell portions may be respective stacked assemblies of pre-impregnated fibre-reinforced laminae.

BRIEF DESCRIPTION OF THE DRAWINGS

Embodiments of the invention will now be described by way of example with reference to the accompanying drawings in which.

DETAILED DESCRIPTION

Figure 1:
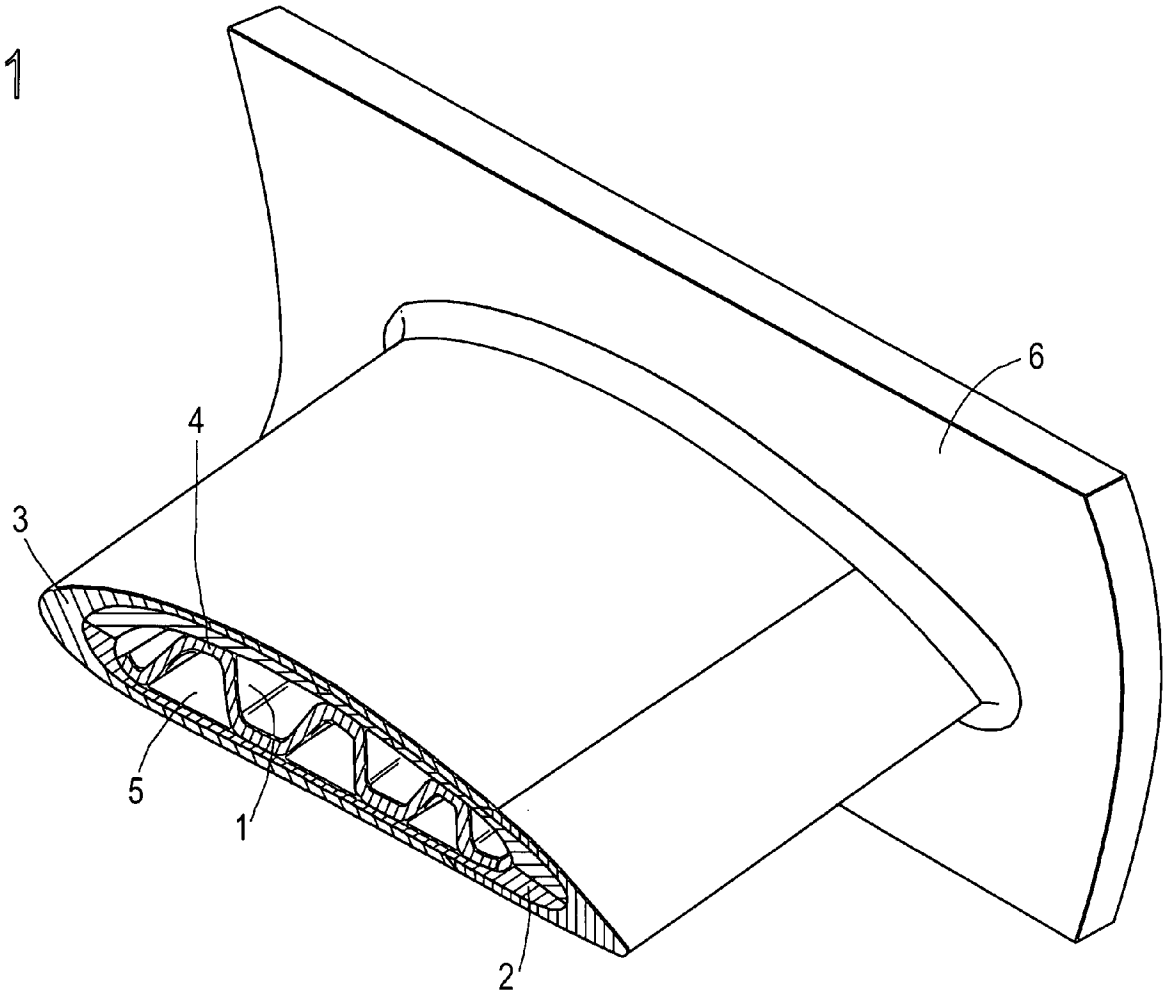
FIG. 1 shows schematically a perspective view of an embodiment of an airfoil according to the present invention.

FIG. 1 shows schematically a perspective view of an embodiment of an airfoil according to the present invention.

The airfoil has a corrugated core 1, and a hollow shell formed from an inner layer 2, and an outer layer enveloping the inner layer 3. The core has lands 4 which contact inner surfaces of the inner layer to support the hollow shell. The inner surfaces of the inner layer and surfaces of the core define passages 5 which extend from one end of the airfoil to the other. End caps 6 (only the far cap being shown in FIG. 1) close the ends of the airfoil.

Figure 2:
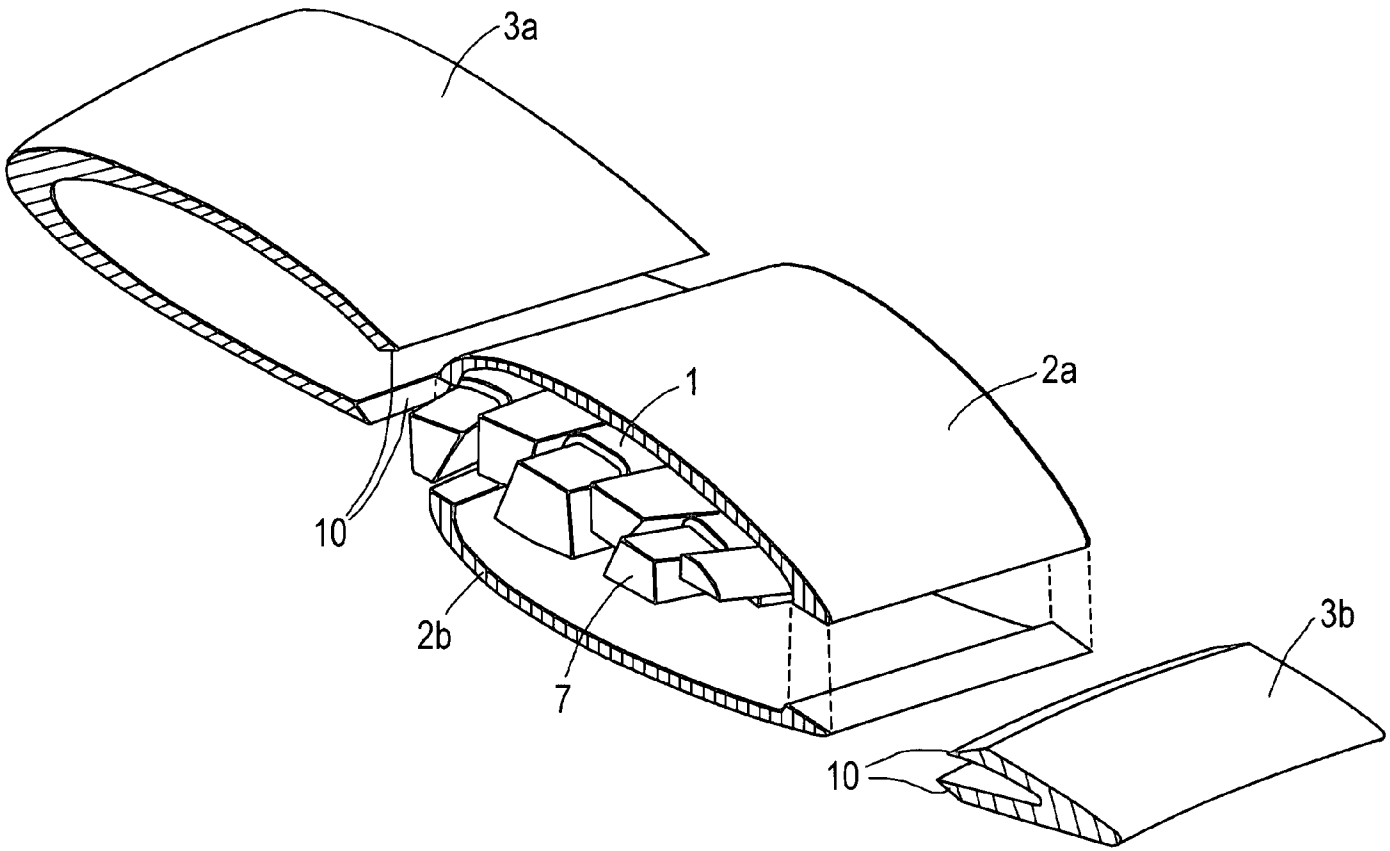
FIG. 2 is an exploded view of parts of the airfoil of FIG. 1.

FIG. 2 is an exploded view of parts of the airfoil of FIG. 1 (excluding the cap). Before consolidation of the airfoil, a pre-form for the corrugated core 1 is produced by hot-pressing a flat fibre-reinforced laminated sheet of thermoplastic into the desired corrugated shape. The inner layer 2 has suction side 2*a* and pressure side 2*b* shell portions, and the outer layer 3 has leading edge 3*a* and trailing edge 3*b* shell portions. Before consolidation of the airfoil, the inner suction side and pressure side shell portions are formed into the desired shapes by hot-pressing fibre-reinforced laminated sheets of thermoplastic, and the edge shell portions are formed by injection moulding chopped strand reinforced thermoplastic to produce unitary bodies which wrap around their respective edges.

To produce the airfoil, the pre-form for the core 1 and a pre-form for the hollow shell, assembled from the shell portions 2*a*, 2*b*, 3*a*, 3*b*, are brought together. The pre-forms are then consolidated by the application of heat and pressure. The core 1 bonds to the inner surfaces of the side shell portions 2*a*, 2*b*; the side shell portions 2*a*, 2*b* themselves bond together along the leading and trailing edges of the airfoil; and the edge shell portions 3*a*, 3*b* bond to and envelope the outer surfaces of the side shell portions 2*a*, 2*b*. In this way, the joints between the side shell portions 2*a*, 2*b* are protected by the edge shell 3*a*, 3*b* portions. The edge shell 3*a*, 3*b* portions have corresponding bevelled joining edges 10 at which they bond together along the suction and pressure sides of the airfoil. To prevent the core 1 from collapsing, mandrels 7 are inserted in the passages 5 during consolidation. The mandrels are removed after the consolidation is complete.

Figure 3:
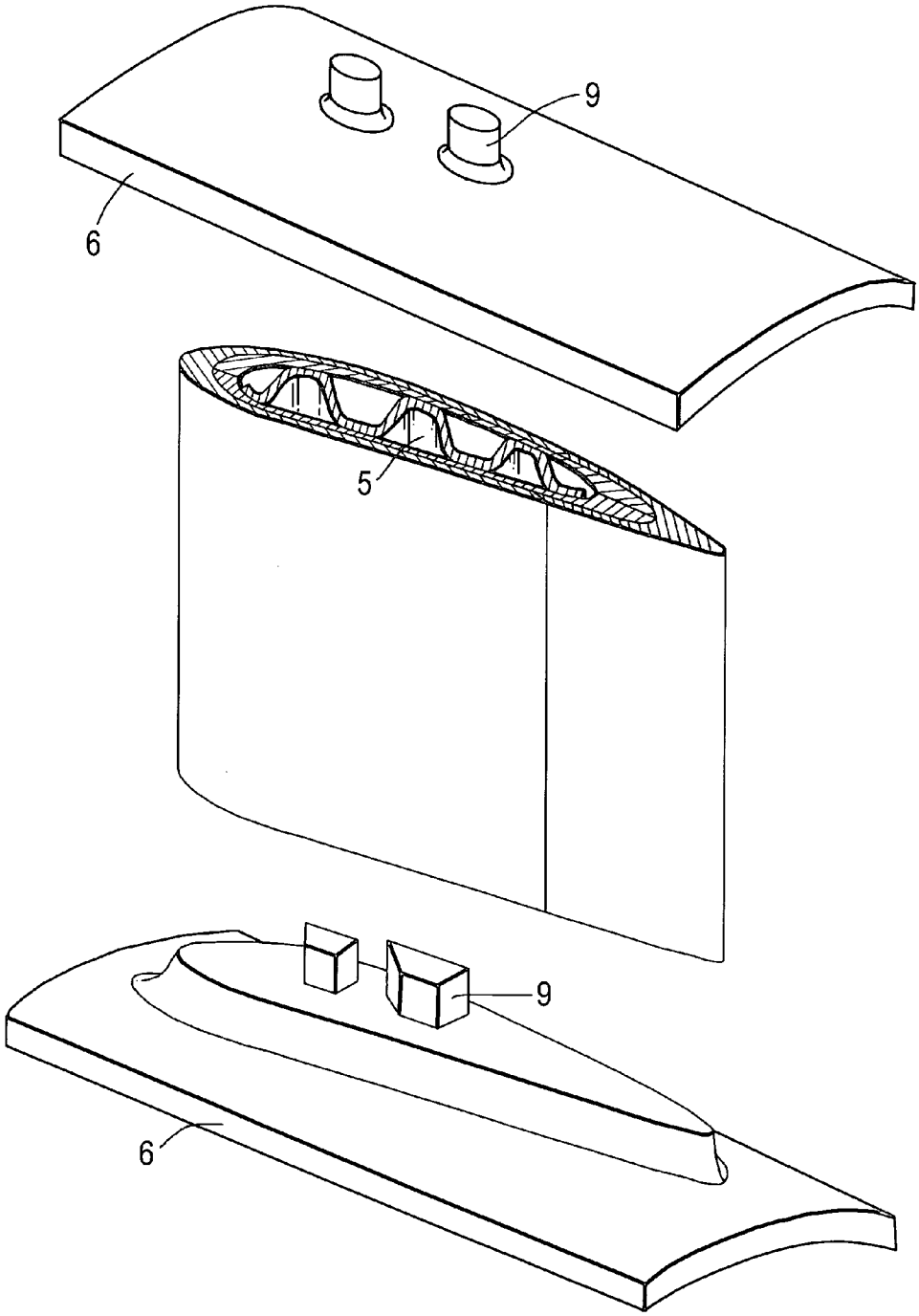
FIG. 3 is an exploded view of the consolidated airfoil of FIG. 1 and its end caps.

FIG. 3 is an exploded view of the consolidated airfoil and its end caps 6. The caps are added to each end of the airfoil and formed with openings 9 that allow communication with at least some of the passages 5. The caps are also formed from thermoplastic, but use chopped strand reinforcement to facilitate injection moulding of their relatively complex shapes. The caps can be joined to the ends of the airfoil by e.g. localised welding or adhesive.

Advantageously, the airfoil is relatively easy to manufacture. It is also easier to recycle than e.g. fibre-reinforced epoxy based systems.

In a gas turbine engine, the airfoil can perform the same tasks as hollow metallic guide vanes, but can additionally convey fluids and/or wiring through the passages, either directly through the passages or via service pipes inserted through the passages. The airfoil can also be lighter than a hollow metallic equivalent.

By forming the core 1 and particularly the side shell portions 2*a*, 2*b* of thermoplastic material such as PEEK, PEKK, ABS or PP, the passages can form fluid conduits which are chemically resistant and have good temperature capabilities.

As the corrugated core and the shell are formed from a number of different parts, differential material properties can be readily introduced into the airfoil.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An airfoil having:

a hollow shell providing external airfoil surfaces, and a corrugated core within the shell, the core contacting inner surfaces of the shell to support the shell;

wherein the airfoil is formed by consolidating a hollow shell pre-form and a corrugated core pre-form, and the hollow shell has a leading edge shell portion and a trailing edge shell portion wherein, before consolidation of the pre-forms, each edge shell portion is a unitary body having a shape which wraps around the respective edge.

2. An airfoil according to claim 1, wherein the hollow shell has a leading edge shell portion and a trailing edge shell portion, the edge shell portions being joined together along a suction side of the airfoil and along a pressure side of the airfoil during consolidation of the pre-forms.

3. An airfoil according to claim 1, wherein each edge shell portion is formed of fibre-reinforced thermoplastic composite material.

4. An airfoil according to claim 3, wherein each edge shell portion is formed of chopped strand reinforced injection moulded thermoplastic.

5. An airfoil according to claim 1, wherein surfaces of the core and inner surfaces of the hollow shell are formed of thermoplastic material, the core surfaces and the hollow shell inner surfaces being joined together during consolidation of the pre-forms.

6. An airfoil according to claim 1, wherein the hollow shell has an inner layer and an outer layer, the outer layer having each edge shell portion.

7. An airfoil according to claim 6, wherein the inner layer is formed from a suction side shell portion and a pressure side shell portion which are joined during consolidation at the leading and trailing edges of the airfoil.

8. An airfoil according to claim 7, wherein the suction and pressure side shell portions are respective stacked assemblies of pre-impregnated fibre-reinforced laminae.

9. An airfoil according to claim 1 which is an airfoil component of a gas turbine engine.

10. An airfoil according to claim 1, wherein surfaces of the core and inner surfaces of the hollow shell define passages which extend along the airfoil.

11. An airfoil according to claim 10, further having end caps at the ends of the airfoil, the end caps having openings which provide access to the passages.

12. An airfoil according to claim 10, wherein one or more of the passages are configured to act as fluid or wiring conduits.

13. An airfoil according to claim 10, wherein one or more of the passages contain fluid and/or wiring that is conveyed through the airfoil.

14. A method of producing the airfoil of claim 1, including the steps of:

providing a hollow shell pre-form and a corrugated core pre-form, the hollow shell pre-form having a unitary leading edge shell portion and/or a unitary trailing edge shell portion, wherein each edge shell portion has a shape which wraps around the respective edge;

positioning the corrugated core pre-form within the hollow shell pre-form; and consolidating the hollow shell pre-form and the corrugated core pre-form to produce the airfoil.

15. A method according to claim 14, wherein the hollow shell pre-form has an outer layer and an inner layer, the outer layer having each edge shell portion.

16. A method according to claim 15, wherein the inner layer is formed from a suction side shell portion and a pressure side shell portion which are joined during consolidation at the leading and trailing edges of the airfoil.

17. A method according to claim 16, wherein the suction and pressure side shell portions are respective stacked assemblies of pre-impregnated fibre-reinforced laminae.

18. A method according to claim 14, wherein the consolidation step includes pressing and heating the hollow shell pre-form and the corrugated core pre-form to join the pre-forms together.

19. A method according to claim 14, wherein the positioning step includes positioning removable mandrels around the corrugated core pre-form to support the corrugated core pre-form during the consolidation step.

20. An airfoil according to claim 11, the end caps comprising at least one boss part comprising the openings, wherein the boss parts extend at least partially into the passages.

* * * * *